United States Patent [19]

Schenk

[11] 3,962,951

[45] June 15, 1976

[54] MISSILE LAUNCHING AND HOLD-DOWN DEVICE THEREFOR

[75] Inventor: Jan M. Schenk, Menlo Park, Calif.

[73] Assignee: The United States of America as represented by the Secretary of the Navy, Washington, D.C.

[22] Filed: Apr. 1, 1975

[21] Appl. No.: 563,993

[52] U.S. Cl. ..... 89/1.81; 89/1.817; 85/8.9; 403/326; 403/344

[51] Int. Cl.[2] ..... F41F 3/04

[58] Field of Search ..... 89/1.81, 1.817, 1.8, 89/1.809; 102/94; 403/326, 344; 85/8.6, 8.9, 51

[56] References Cited

UNITED STATES PATENTS

| | | | |
|---|---|---|---|
| 2,509,081 | 5/1950 | Bluth et al. | 85/51 X |
| 2,580,396 | 1/1952 | Bluth | 85/8.9 |
| 3,158,062 | 11/1964 | Feiler | 89/1.817 X |
| 3,160,425 | 12/1964 | Sinnott | 85/8.9 X |
| 3,180,222 | 4/1965 | Moy | 89/1.810 |
| 3,279,319 | 10/1966 | Semonian et al. | 89/1.810 |
| 3,473,202 | 10/1969 | Howard | 403/344 X |
| 3,499,364 | 3/1970 | D'Ooge | 89/1.810 |
| 3,876,318 | 4/1975 | Crispell | 403/344 X |
| 3,887,991 | 6/1975 | Panella | 403/326 X |

*Primary Examiner*—David H. Brown
*Attorney, Agent, or Firm*—R. Sciascia; R. Beers; S. Sheinbein

[57] ABSTRACT

The missile launching assembly includes a mount tube having a circumferential tapered continuous groove, a launch tube within the mount tube, a shatterable end closure on the end of the launch tube adapted to be shattered when the missile is launched, a locking device in the form of a single split ring or a plurality of arcuate-shaped ring segments with a cross-section to match the groove taper positioned within the groove and between the mount tube and the flange of the end closure, and one or more circumferentially oriented spreading elements, such as expanding jackscrews fitted into the ring or ring segments for increasing the ring circumference to bring pressure to bear on the closure flange. The launch tube is designed to contain therein in a lengthwise direction the missile to be fired.

The mount tube is a permanent part of the vehicle such as a submarine, from which the missile is to be launched.

7 Claims, 8 Drawing Figures

MISSILE LAUNCHING AND HOLD-DOWN DEVICE THEREFOR

BACKGROUND OF THE INVENTION

This invention relates to missile launch tube closures which must be replaced after every missile firing, useful in submarines, and particularly to hold-down devices for said launch tube closures.

Known submarine launch tube closures use many bracket and jackscrew assemblies which are bolted to the mount tube as hold down devices. These submergible assemblies may use as many as 24 hold-down bolts and must all be removed and reinstalled when a shatterable closure is replaced after a missile firing. All jackscrews must be torqued in a specified sequence, usually several times. This procedure is time consuming, and even after the jackscrews are torqued the torque values vary drastically, resulting in an undesirable misbalance of forces.

It has been suggested that a clamp ring be applied to the flat end flange of the shatterable closure. A problem associated with this suggested procedure is that there is a tendency for the closure flange to pull out from under the clamp ring.

The present invention overcomes the foregoing disadvantages and problems by providing a new, improved and simplified technique for clamping a shatterable type of end closure to a launch tube by the use of a ring which performs more efficiently the function of the hold-down bolts of the prior devices.

An object of the present invention is to provide a hold-down device for a missile launch tube closure which is thinner, lighter in weight, more flexible and much easier to install than known types of hold-down devices.

Another object is to obtain an uninterrupted and uniform clamping force or uniform load distribution around the entire closure clamping flange of the end closure of a missile launch tube without danger of the closure flange pulling out from under the hold-down device when the end closure is pressurized from below.

Other objects and advantages will appear from a reading of the following description.

BRIEF DESCRIPTION OF THE INVENTION

The design of the invention comprises a tapered circumferential groove near the upper end of the mount tube which forms an integral part of the submarine, a single split ring of metal, such as steel or arcuate-shaped ring segments, with a cross-section to match the groove taper and closure flange taper, if any, for insertion between the mount tube and the closure clamping flange, and one or more circumferentially oriented expandable jackscrews to lock the ring firmly in position. The contact loads (including friction) on the tapered groove surface of the mount tube and on the closure flange surface preferably intersect at or near the elevation of the center of gravity of the ring cross-section to prevent any tendency for the cross-section to rotate, because of the different radial locations of the two contact surfaces, the groove taper angle (relative to the horizontal) will normally be greater than that of the flange.

BRIEF DESCRIPTION OF THE DRAWING

Throughout the figures of the drawing like parts are represented by like reference numerals, and equivalent parts by the same numerals with prime designations.

DETAILED DESCRIPTION

Figure 1:
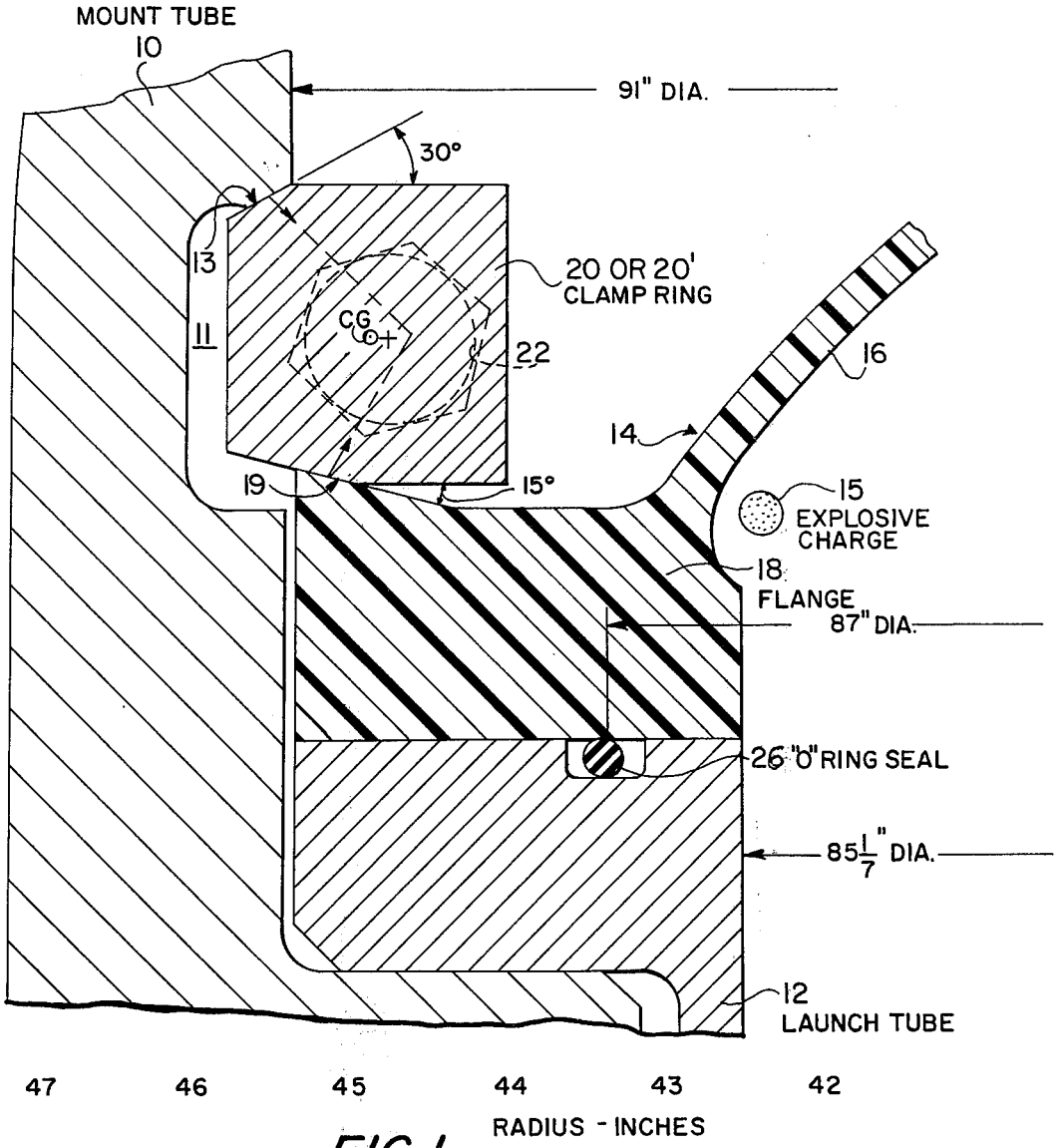
FIG. 1 is a vertical sectional view of only one side of the missile launch tube, the mount tube forming an integral part of the submarine, the shatterable end closure, and the clamp ring assembled in accordance with the invention.
Figure 4A:
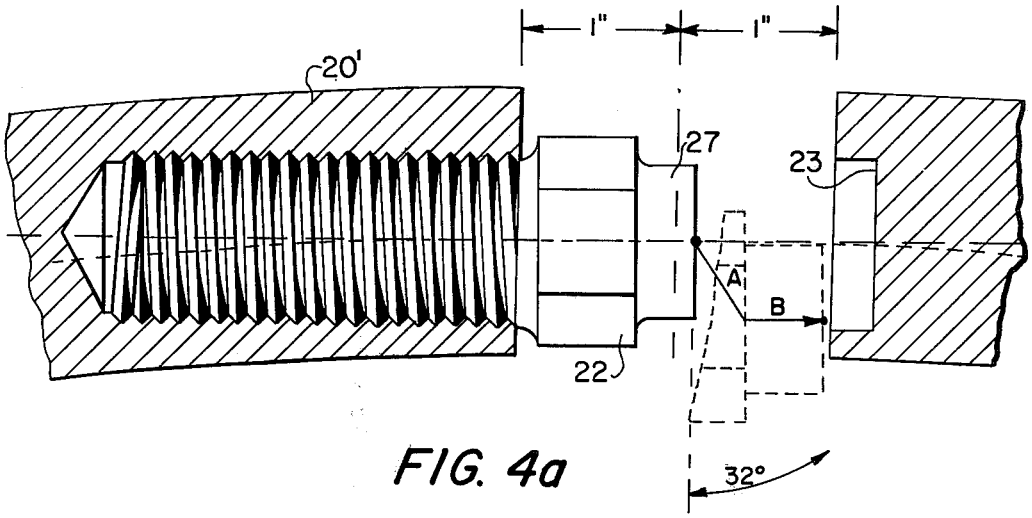
FIGS. 4*a* and 4*b* show an expanding type jackscrew which could be used with the split ring device of FIG. 1 to increase the ring circumference to enable the ring to fit tightly within the tapered groove.
Figure 4B:
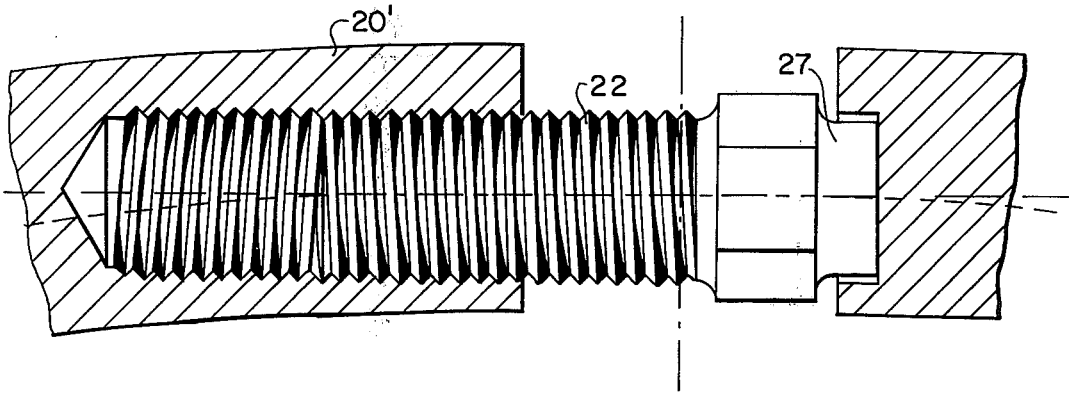
Figure 5A:
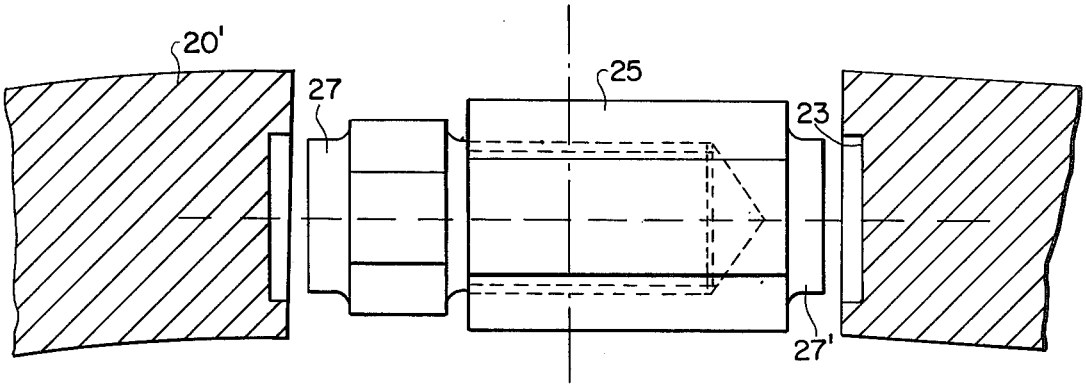
FIGS. 5*a* and 5*b* show a jackscrew as part of a separate spreading device to obtain the same result as the arrangement of FIG. 4.
Figure 5B:
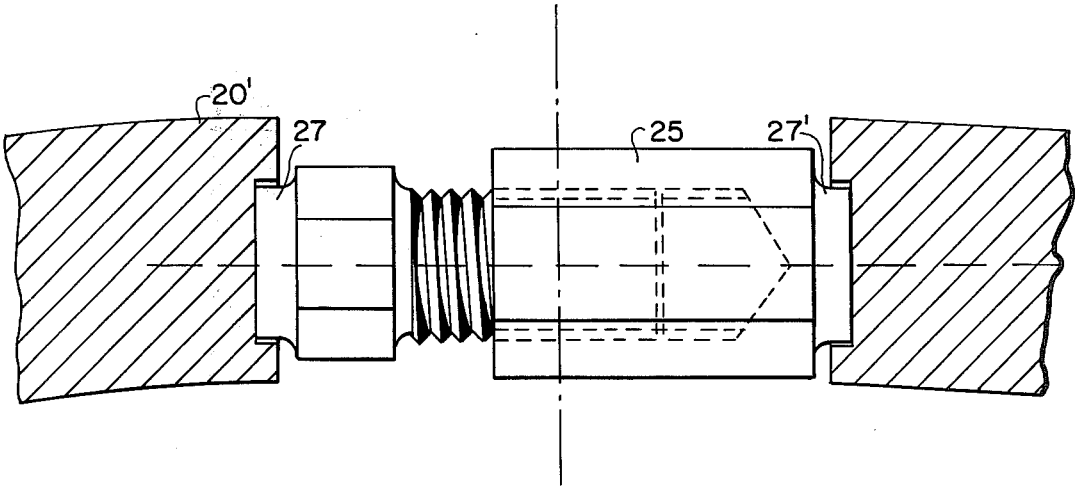
Figure 6:
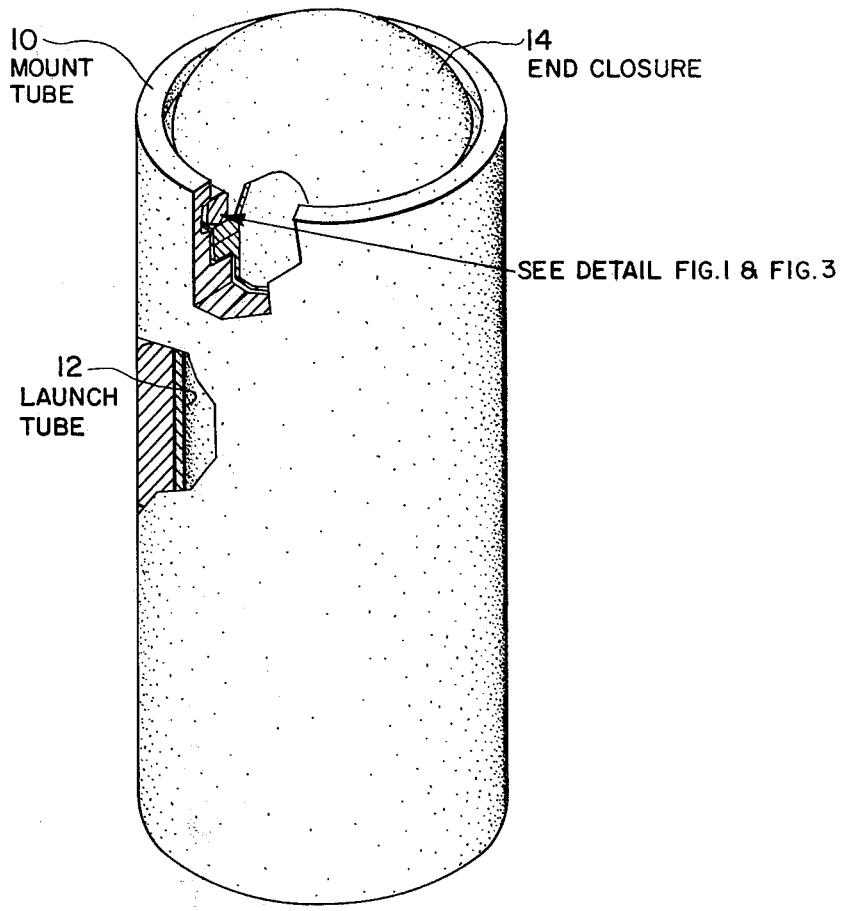
FIG. 6 is a side elevation view, partly in perspective and partly cut away, of the construction of FIG. 1.

The assembly of missile launch tube closure with hold down locking device according to the invention, as shown in FIGS. 1 and 6 comprises a metal, such as steel, mount tube 10 forming an integral part of the vehicle, such as a submarine, in which the missile to be fired is mounted, a metal launch tube 12 containing the missile, not shown, a shatterable type end closure 14 having a dome portion 15 and a circularly arranged flange portion 18, a steel clamp ring 20, and expandable jackscrews 22 shown in dotted lines in FIG. 1 and in greater detail in FIGS. 4 and 5. The end closure 14 may be made from a plastic material such as asbestos-reinforced phenolic plastic. An O ring seal 26 is positioned between the lower flat surface of the end closure flange 14 and the adjacent surface of the launch tube 12. Details of the clamp ring are illustrated in FIGS. 2 and 3.

The upper part of the mount tube is in the form of a hook having a circumferential groove 11 which is tapered at 13. The top of the launch tube 12 is below the groove 11. The end closure flange 18 which rests on the launch tube 12 may have a tapered upwardly protruding portion 19 to enable the clamp ring to exert a greater radially outward pressure component on the flange than would be possible if this end portion were flat.

Figure 2:
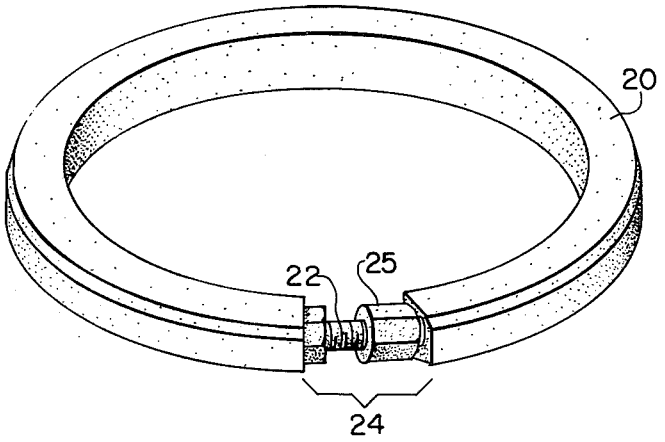
FIG. 2 shows a single split ring with a spreading element in the form of single jackscrew for use between the circumferential tapered groove in the mount tube and the clamp flange of the shatterable end closure which, in turn, is mounted at the end of the launch tube, as illustrated in FIG. 1.
Figure 3:
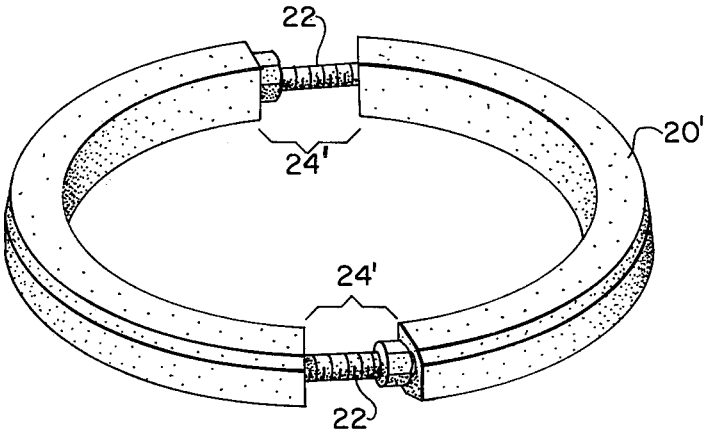
FIG. 3 shows a two-segmented ring which may be used instead of the single split ring of FIG. 2, and having two jackscrews.

The clamp ring 20 may be a single split steel ring as shown in FIG. 2 or a steel segmented ring 20' as shown in FIG. 3 both of which have expandable circumferentially oriented jackscrew constructions 22 as shown in FIGS. 4 and 5. The clamp ring 20' of FIG. 3 may, of course, have more arcuate-shaped segments than the two shown segments shown in FIG. 3, interconnected in the manner shown in either FIG. 4 or FIG. 5. The upper and lower surfaces of the clamp ring 20 or 20' are machined to have a tapered cross-section in order to fit snugly into the groove taper 13 and the flange taper 19.

The contact loads (including friction) on the two tapered surfaces 13 and 19 intersect at or near the elevation of the center of gravity of the clamping ring cross-section; otherwise this cross-section will tend to rotate. Because of the different radial locations of the two contact surfaces, the groove taper angle of the mount tube 10 (relative to the horizontal) will normally be greater than that of the flange 18. These angles are shown as 30° and 15° in FIG. 1.

The different diametrical dimensions give in FIG. 1 are illustrative of the inside diameters of the mount tube 10 and the launch tube 12, and the diameter of the O ring seal 26.

The jackscrew 22 shown in FIGS. 4a and 4b threads directly into the ring 20'. The jackscrew is provided with a nut-like periphery near one end and a threaded portion at the other end. The threaded portion is adapted to engage the internal threads of one end section of the clamp ring. The adjacent end section of the clamp ring has a recess 23 which mates with the extended portion 27 of the nut of the jackscrews and insures against mis-alignment at installation or accidental dislocation during operation. Upper figure (*a*) of FIG. 4 shows the adjacent portions of the clamp ring before the jackscrew is adjusted to cause circumferential expansion of the ring as shown in figure (*b*) of FIG. 4. The one inch dimensions are given for illustration purposes only. Clearance at the gap 24 of the ring 20 or clearance at the gaps 24' of the ring 20' is required for installation. To minimize bending stresses in the ring, the jackscrew axis should be located approximately at the center of gravity of the ring cross-section.

Where a two-segment clamp ring with gaps between arcuate segments as shown in FIG. 3 is used, the segments would be installed or removed individually. The clearances required for removal (½ inch radial retraction assumed) are shown in FIG. 4. When both ends of a segment are pulled towards center by ½ inch, they will also move sideways relative to the mid point of the segment at an angle of approximately 32°. This motion depicted by arrow A, will clear the ends. An additional sideways motion of ½ inch, depicted by arrow B, is required to clear the remainder of the segment.

An alternative to the jackscrew construction of FIG. 4 is shown in FIG. 5 where a separate insert 25 is employed. The insert 25 is also provided with an extension 27' to fit into a recess in the ring. In FIG. 5, the threaded protion of the jackscrew threadedly engages the separate insert rather than the internal threads of the ring as shown in FIG. 4. It should be noted that with the jackscrew construction of FIG. 4 only one recess is required in the clamp ring whereas with the construction of FIG. 5 utilizing a separate insert 25 the two adjacent ends of the clamp ring at the gap are both provided with recesses. As in FIG. 4, the upper figure (*a*) of FIG. 5 shows the adjacent portions of the clamp ring before the jackscrew is adjusted to cause circumferential expansion of the ring as shown in figure (*b*) of FIG. 5.

An advantage of the construction of FIG. 5 over that of FIG. 4 is that the ring segments could be thinner, lighter, more flexible, and much easier to install even though more parts (the separate insert) are added. Where a jackscrew is threaded into a ring segment, the gross cross-sectional area must be much larger than would be required elsewhere.

Although a single clamp ring as shown in FIG. 2 is attractive from the standpoint of its simplicity, two or more segments for the clamp ring utilizing the construction of FIG. 3 offer the advantages of simplified and more accurate machining of the threaded holes, easier assembly, shorter jackscrews, and less circumferential friction resulting in more uniform and load distribution.

The tapered design of the flange 18 at 19 of the end closure minimizes the tendency for the flange to pull out from under the clamp ring. Elimination of the closure flange taper at 19, which would be associated with a decrease in required taper angle at the groove of the mount tube 10, has the advantages of a more simplified end closure and a smaller jackscrew load required for the same clamping load. However it has some disadvantages, such as more sensitivity to vertical manufacturing tolerances and more circumferential friction and sliding during jackscrew tightening. In order to assure a uniform clamping pressure along the entire circumferential end closure flange, the jackscrew constructions are extended by rotation thereof to increase the diameter of the steel clamping ring. As an example, the extension of each jackscrew by 3,14 inches may increase the ring diameter by 1 inches. As the ring diameter increases, the vertical pressure between the mount tube at taper 13 and the flange 18 increases as a result of which the clamp ring is wedged tightly between the mount tube and the closure flange to immodilize these two items. Each time the missile within the launch tube is to be fired an explosive charge indicated diagrammatically at 15 on FIG. 1 in the interior of the frangible end closure is detonated in well known manner to shatter the end closures. The explosive charge may be a mild detonating fuse or equivalent explosive cord arranged circumferentially within the end closure substantially at the location indicated in FIG. 1. After the end closure is shattered and the missile launched, the clamping ring is loosened by decreasing the diameter of the ring by means of a wrench turning the nut-like portion of the jackscrew in the proper direction. The flange from the shattered end closure is removed and another end closure installed after first inserting another missile into the launch tube. Then the clamping ring is pushed into the groove and caused to increase its diameter by extending the jackscrews.

The ease of installing the end closure, the ease in removing the flange after the end closure is shattered, and the positive action of the clamp ring in insuring a desired uniform load pressure on the flange are distinct advantages over and above the use of numerous bracket and jackscrew assemblies bolted to the mount tube characteristic of prior art hold-down devices.

Obviously, many modifications and variations of the present invention are possible in light of the above teachings. It is therefore to be understood that, within the scope of the appended claims, the invention may be practiced otherwise than as specifically described.

What is claimed is:

1. A missile launching device comprising:

a mount tube having a circumferential groove near one end of the mount tube, said groove having a tapered surface;

a launch tube within said mount tube below the location of said groove, said launch tube being adapted to contain therein in a lengthwise direction the missile to be launched;

a shatterable end closure for said device having a circumferential flange resting on said launch tube and predominately below said groove;

and a split ring positioned in said groove engaging both said tapered surface of said groove and said flange below said tapered surface; said split ring having a gap;

an adjustable spreading element in said gap for engaging both ends of said split ring at said gap, said element being rotatable for exerting expanding circumferential pressure on said ring at the location of said gap to thereby increase the diameter of said ring and increase the pressure on said flange.

2. A missile launching device according to claim 1 wherein said ring is provided with a plurality of arcuateshaped segments, there being gaps between adjacent ends of said segments, and adjustable spreading elements in said gaps.

3. A missile launching device according to claim 1 wherein said mount and launch tubes and said split ring are made of steel and said end closure is made from asbestos-reinforced phenolic plastic.

4. A missile launching device according to claim 1 wherein said spreading element is a jackscrew one end portion of which is adapted to fit into a recess in said ring at said gap and the other end portion of which is threaded.

5. A missile launching device according to claim 4 wherein said one end portion of said jackscrew is provided with a periphery in the form of a nut to enable lengthwise movement of said jackscrew.

6. A missile launching device according to claim 1, wherein said flange has a tapered surface adapted to engage said ring when it is fitted in said groove, said spreading element being a jackscrew one end portion of which is adapted to fit into a recess in said ring at said gap and the other end portion of which is threaded.

7. A missile launching device according to claim 6 wherein said ring is tapered in cross-section to fit into and between the tapered surface of said groove and the tapered surface of said flange.

* * * * *